United States Patent [19]

Raaness et al.

[11] Patent Number: 4,787,320

[45] Date of Patent: Nov. 29, 1988

[54] METHOD AND APPARATUS FOR THERMAL TREATMENT

[76] Inventors: Ola S. Raaness, Sandsvei 13; Steinar Prytz, Overlege Kindtsgt. 27, both of 7000 Trondheim; Aud N. Waernes, Rostengrenda 35, 7075 Tiller, all of Norway

[21] Appl. No.: 53,851

[22] PCT Filed: Sep. 19, 1986

[86] PCT No.: PVT/NO86/00066

§ 371 Date: May 26, 1987

§ 102(e) Date: May 26, 1987

[87] PCT Pub. No.: WO87/01792

PCT Pub. Date: Mar. 26, 1987

[30] Foreign Application Priority Data

Sep. 23, 1985 [NO] Norway ..... 853714

[51] Int. Cl.[4] ..... F23G 5/00; F23G 5/10; F23G 5/12

[52] U.S. Cl. ..... 110/250; 110/346

[58] Field of Search ..... 110/250, 346; 75/10.19, 75/10.66

[56] References Cited

U.S. PATENT DOCUMENTS 4,519,835 5/1985 Gauvin et al. ..... 75/10.19
4,644,877 2/1987 Barton et al. ..... 110/250

FOREIGN PATENT DOCUMENTS 0082317 7/1981 Japan ..... 110/250
8701137 2/1987 U.S.S.R. ..... 75/10.19

*Primary Examiner*—Edward G. Favors
*Attorney, Agent, or Firm*—Dennison, Meserole, Pollack & Scheiner

[57] ABSTRACT

A method is described for a thermal treatment of materials that can be pumped or blown, particularly for the pyrolysis of waste materials, An electric arc is established in a gap between a pair of concentric electrodes, and the material to be treated is pumped or blown into the gap and through the electric arc to effect the thermal treatment. The product of the thermal treatment is forced to pass through a high temperature smelt. The method can be carried out utilizing a sealed receptacle (11) equipped with an electrode tube (15) having a material supply at one end and an open end directed towards or located in the smelt. A sleeve or other wall means can be placed in the receptacle near the electrode tube to create circulation and spread the decomposition products in the smelt.

9 Claims, 3 Drawing Sheets

METHOD AND APPARATUS FOR THERMAL TREATMENT

BACKGROUND OF THE INVENTION

The invention concerns a method of thermal treatment of materials/substances that can be pumped or blown, particularly concerning the pyrolysis of waste products where the material/substance is pumped or blown into a heat chamber with a high temperature smelt, preferably a metal smelt, and where the heat chamber receives the thermic energy required from the electrical discharge of electrodes.

A range of chemical compounds are extremely stable or have stable decomposition products. Most of these compounds can however be broken down into their separate chemical components by maintaining the initial materials at a high temperature for a long period of time. This can be exemplified by the destruction of various types of wase, from for instance the production of plastics. For this purpose there are known pyrolysis plants with metal baths where the substance which is to be thermically processed resp. destructed is fed into the metal bath and heated by and in it by means of electrodes with an electrical discharge over the metal bath. Methods such as this will not produce high enough temperatures or long enough exposure for the most exacting thermal processes such as the destruction of matter.

SUMMARY OF THE INVENTION

The main object of the invention is to provide a method resp. an apparatus for the thermal treatment of substances which can be pumped or blown, where a predetermined high temperature and sufficient exposure in the heated zone is obtained for a given substance. Another object is finding a method and an apparatus where thermal treatment can be carried out without the addition of an oxidizing agent and which in a simple manner allows the collection of the gases and the other products of pyrolysis connected with the thermal treatment.

These and other objects of the invention can be achieved by a method for thermal treatment of pumpable or blowable materials comprising establishing an electric arc between a pair of concentric electrodes. The material to be treated is pumped or blown into the gap, through the electric arc to effect the thermal treatment, and the product of the thermal treatment is passed through a high temperature smelt.

At the end of the electrodes where the electric arc discharges occur, the temperature is in the region of 5000°-12000° K., and the material to be destructed is forced to pass through this area. Lengthy exposure at a high temperature is ensured by forcing the products of the thermal treatment/pyrolysis in the vicinity of the electrodes to pass through a smelting bath which contributes to a final catalytic decomposition of extremely stable organic compounds.

The apparatus for carrying out the thermal treatment described includes a sealed receptacle adapted to contain a high temperature smelt, a pair of concentrically arranged electrodes extending into the receptacle and having a gap therebetween which is open to the interior of the receptacle at the end of the electrodes, means for establishing an electric arc in the gap, means for introducing the pumpable or blowable materials into the gap a predetermined distance from the open end of the gap to effect the thermal treatment of the materials in the arc, means to cause the products of the thermal treatment to pass beneath the surface of the smelt, and means for removing the products of the thermal treatment which are in gaseous form from the receptacle after passing through the smelt. Thermal treatment with the apparatus according to the invention is possible without the addition of oxidizing agents. This reduces the amount of gas which has to be treated. Any valuable elements in the redisual gas will consequently be more concentrated and in an easier utilized form than was previously found in combustion processes.

Following the destruction of the non-halogencontaining organic matter, the products of pyrolysis will consist of carbon (Carbon Black), $H_2$, CO as well as smaller quantities of $N_2$. Carbon Black will follow the gas out.

Following the destruction of halogen-containing waste matter from the production of plastics, the products of pyrolysis will contain carbon (Carbon Black) and smaller quantities of halogenides which can be filtered off from the gas. The gas may usually consist of 60-96% HCl, 1-30% CO, 1-5% $H_2$ as well as 2-8% $N_2$ all calculated on the basis of weight. Such a gas mixture is a suitable starting point for the production of technical hydrochloric acid using an existing method.

In some cases, the materials which are to be subjected to thermal treatment may contain heavy metals. Thus following destruction the main part of the most common heavy metals will remain in the metal bath. The metal bath must consequently be refined in known manner from time to time to catch the heavy metals in a slag smelt.

Some types of organic materials such as dioxines and polychlorinated biphenyls are difficult to destruct entirely by combustion processes alone, as the temperature should be in the region of 1200°-1800° C. for complete destruction. The method and apparatus according to the invention facilitate the destruction of such materials without the addition of combustibles at the same time as the destruction temperature can be selected independently of the combustible value of the material. This will result in less gas being produced than is the case with any other method known.

BRIEF DESCRIPTION OF THE DRAWINGS

The invention will be described more closely below by reference to the drawings where.

DESCRIPTION OF THE PREFERRED EMBODIMENTS

Figure 1:
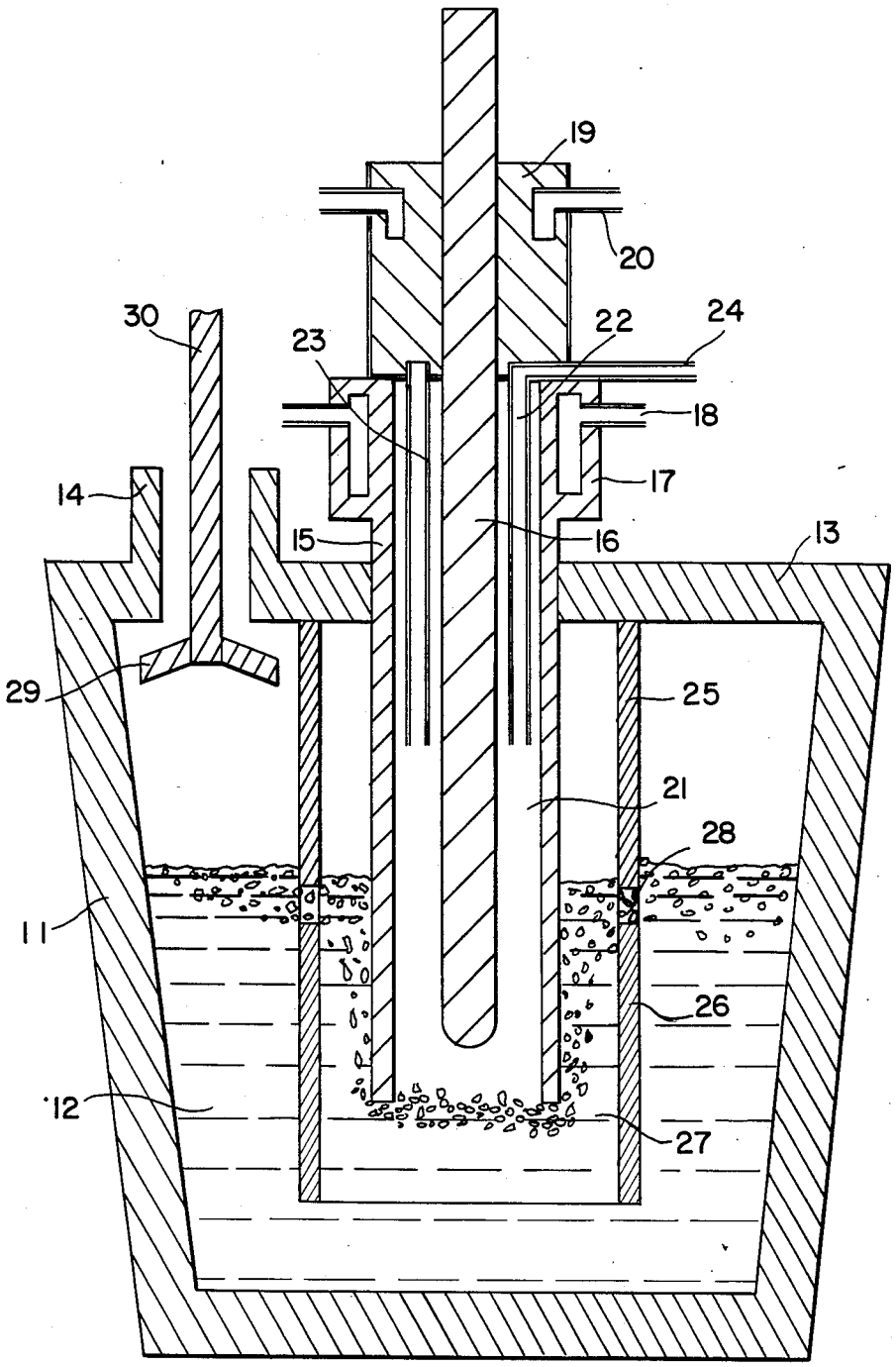
FIG. 1 illustrates a vertical cross-section in a shematic presentation of central parts of an apparatus for realizing the method according to the invention.

In FIG. 1, a sealed thermically-insulated receptacle or container 11 for a metal smelt 12 is shown. There is an opening in the lid 13 with a pipe connection 14 for the outlet of gas and a central opening for an electrode tube 15. The electrode tube 15 is led down into the metal smelt 12, in the example this is about half-way into it. A rod-shaped electrode 16 is located centrally in the electrode tube 15.

The pair of electrodes 15–16 constitute a unit and can be shaped as described in Norwegian Patent No. 141.183. Other heat sources based on electrodes can also be used providing they produce sufficiently high temperatures and where the electrodes can be built into a chamber where the exhaust gases from the combustion unit are forced to rise through a metal bath.

In the example the upper part of the electrode tube 15 is attached to a lower electrode holder 17 to which a coolant, preferably water, and electric current are supplied through a combined coolant and electric conductor 18.

The coaxially-located electrode rod 16 is attached to the upper electrode holder 19 which has a combined supply of coolant and electric current 20.

The upper electrode holder 19, is electrically insulated from the lower electrode holder 17 and vice versa.

The upper electrode holder can be equipped with a device which can continuously displace the central electrode rod in an axial direction in relation to the outer electrode tube. This is not illustrated in FIG. 1. Between the electrode tube 15 and the electrode rod 16 there is an annular space 21. Into the annular space 21 in the division between the upper and lower electrode holders one or more supply conduits are led. The example shows two of these supply conduits, 22 and 23, which supply the material which is to be thermically treated and are supplied from a feed pipe 24. The feed pipe 24 can be linked to a dosage unit which pumps or blows controlled amounts of the substance into the annular space. Following the introduction of this matter, a gas zone will be formed in the lower part of the annular space 21 in the electrode tube 15. This gas zone will extend into the metal bath 12 and will be kept heated by the electrical discharge at the end of the electrodes. Thermal treatment such as the destruction of the material which has been fed in will commence in this area. The gas supplied and the gas generated by the heating will recede from the bottom of the metal bath 12 and flow up the outer side of the electrode tube 15.

At a certain distance from the outside of the electrode tube 15, a pipe 25 has been located under the lid 13 with its free end 26 lowered into the metal bath to spread the discharged gas in a larger part of the metal bath 12. Furthermore, this allows longer contact time between the material and the hot metal bath. The free ende 26 creates an annular space 27 around the electrode tube 15. From this annular space there are radial openings 28, for example four out from the pipe 25 in the metal bath. When gas is supplied to the metal bath the mean specific weight of the metal bath will be reduced in the bubble region compared with the metal smelt without bubbles. This difference in density results in setting the metal bath into circulation, leading to increased contact time between the gas and the smelt.

Figure 2A:
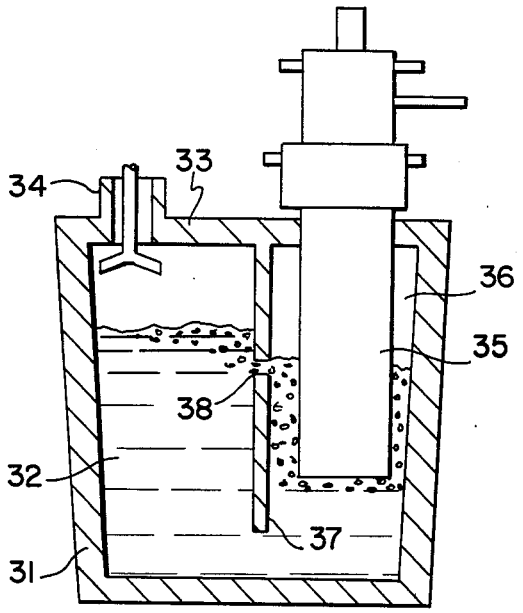
FIG. 2A and 2B show a vertical cross-section and a horizontal cross-section, respectively of an alternative embodiment, whilst
Figure 2B:
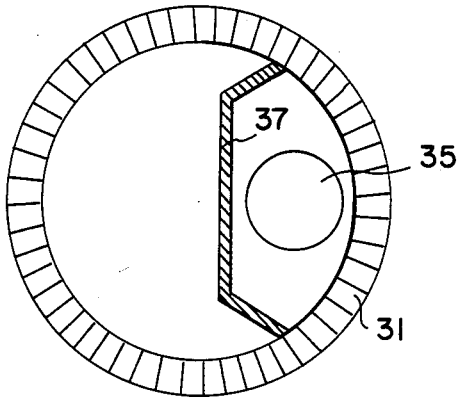

The metal spray is reduced by fitting the outlet for the products of pyrolysis through the connection pipe 14 with a stop plate 29 located on a central support 30. The intimate mixture of gas and smelt given by the pipe end 26 can also be achieved by other configuratins. One such design is exemplified in FIGS. 2A and 2B, which illustrate a sealed thermically insulated receptacle or container 31 for a metal smelt 32. There is a connection pipe 34 in the lid 33 of the receptacle for the extraction of gas, and an opening for the combustion unit 35. The combustion unit 35 and the supply conduits for the material to be thermically treated have been described above in connection with FIG. 1. However, in this configuration the combustion unit is located in a gas-tight chamber 36. The chamber 36 may be a part of the container 31 separated from the rest of the container with a vertical dividing wall 37 that is lowered into the metal smelt 32. There are gaps 38 in the dividing wall 37 which ensure the circulation of gas and smelt in the receptacle 31. When the chamber 36 is gas-tight, the decomposition products from the combustion unit 35 are forced through the gaps 38 in the dividing wall 37 since the outlet for gas 34 is located outside the chamber 36. The chamber 36 and the combustion unit 35 can be located in different parts of the receptacle. Ther are a number of other usable configurations for the dividing wall than the one illustrated here.

Figure 3:
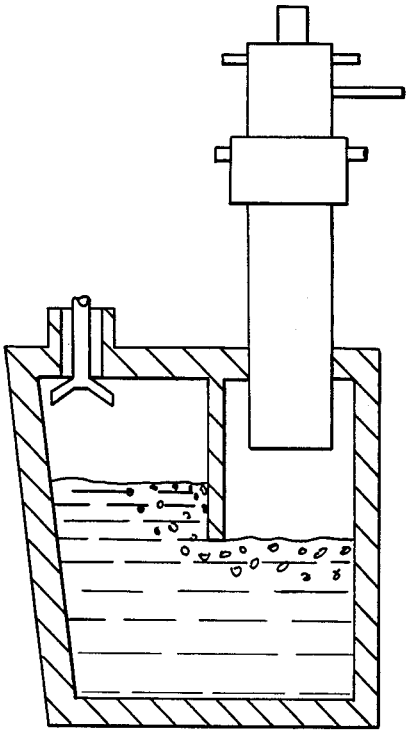
FIG. 3 shows yet another embodiment from a vertical cross-section.

FIG. 3 illustrates a third embodiment with a non-perforated dividing wall. More detailed information about materials and dimensions are indicated, since these are considerations which have to be scientifically determined and adjusted to the various application areas.

Alternative solutions:

The congiguratins shown can be modified in a variety of ways. The electrode combustion unit described can be replaced by another type of electrode system where the pipe 25 is mounted on the electrode tube 15 to spread and increase the duration of the gas in the metal bath, and where the "mammoth pump" principle as it is frequently termed can either be excluded or made more extensive. The intimate micture between the gas and the smelt which is the result of the skirt 26 can also be achieved by using other configurations. One example of such is shown in FIG. 2.

What is claimed is:

1. A method for thermal treatment of pumpable or blowable materials comprising establishing an electric arc in a gap between a pair of concentric electrodes, pumping or blowing said materials into said gap and through said electric arc to effect said thermal treatment, and passing the product of said thermal treatment through a high temperature smelt.

2. A method according to claim 1, wherein said thermal treatment comprises pyrolysis of waste materials.

3. A method according to claim 1, wherein said smelt is a metal smelt.

4. A method according to claim 1, wherein said concentric electrodes extend below the surface of said smelt.

5. A method according to claim 1, wherein circulation is created in the smelt.

6. An apparatus for thermal treatment of pumpable or blowable materials comprising:

a sealed receptacle adapted to contain a high temperature smelt;

a pair of concentrically arranged electrodes extending into said receptacle, said electrodes defining a gap therebetween, the gap being open to the interior of said receptacle at the end of said electrodes;

means for establishing an electric arc in the gap;

means for introducing pumpable or blowable materials into the gap a predetermined distance from the open end of the gap, whereby thermal treatment of the materials can take place in the arc to produce products including gaseous products;

means causing the products of the thermal treatment to pass beneath the surface of the smelt; and means for removing the gaseous products of the thermal treatment from said receptacle after passing through the smelt.

7. An apparatus according to claim 6, additionally comprising a sleeve concentrically surrounding said electrodes and being open to said receptacle at the end of the sleeve adjacent to the open end of the gap, said sleeve including a plurality of radial bores for establishing movement of the smelt.

8. An apparatus according to claim 7, wherein said sleeve is attached at its upper end to the top of said receptacle in a gas tight manner with the open end of said sleeve directed downwardly, and said bores are adapted to be located below the surface of the smelt.

9. An apparatus according to claim 6, additionally comprising a dividing wall in said receptacle, adapted to extend from the top of said receptacles to a point below the surface of the smelt, said electrodes being located on one side of said dividing wall and said removing means being located on the other side of said dividing wall

* * * * *